US005106725A

United States Patent [19]

Matsuzaka et al.

[11] Patent Number: 5,106,725

[45] Date of Patent: Apr. 21, 1992

[54] SILVER HALIDE GRAINS AND PHOTOSENSITIVE SILVER HALIDE PHOTOGRAPHIC MATERIALS

[75] Inventors: Syoji Matsuzaka; Yukio Ohya, both of Hino, Japan

[73] Assignee: Konica Corporation, Tokyo, Japan

[21] Appl. No.: 758,410

[22] Filed: Aug. 30, 1991

Related U.S. Application Data

[63] Continuation of Ser. No. 541,217, Jun. 30, 1990, abandoned, which is a continuation of Ser. No. 254,398, Oct. 6, 1988, abandoned.

[30] Foreign Application Priority Data

Oct. 14, 1987 [JP] Japan ..... 62-260626

[51] Int. Cl.[5] ..... G03C 1/35

[52] U.S. Cl. ..... 430/567; 430/569

[58] Field of Search ..... 430/567, 569

[56] References Cited

U.S. PATENT DOCUMENTS

| | | | |
|---|---|---|---|
| 3,501,306 | 3/1970 | Illingsworth | 430/567 |
| 4,720,452 | 1/1988 | Takiguchi et al. | 430/567 |
| 4,791,053 | 12/1988 | Ogawa et al. | 430/581 |
| 4,828,972 | 5/1989 | Ihama et al. | 430/596 |

OTHER PUBLICATIONS

James, "The Theory of the Photographic Process", Macmillan Publishing Co., Inc., 1977, p. 22.

E. Moisar, E. Klein: Der Enfluss der Wachstumsbedingungen auf die Kristalltracht der Silberhalogenide, pp. 949 to 957.

*Primary Examiner*—Charles L. Bowers, Jr.
*Assistant Examiner*—Janet C. Baxter
*Attorney, Agent, or Firm*—Jordan B. Bierman

[57] ABSTRACT

Silver halide grains for use in silver halide photography having a regular crystal shape and including at most two irregularly grown crystal faces and a silver halide photo-sensitive material containing these silver halide grains are disclosed.

10 Claims, 4 Drawing Sheets

FIG. 7-a
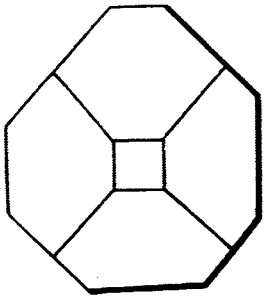
FIG. 7-b
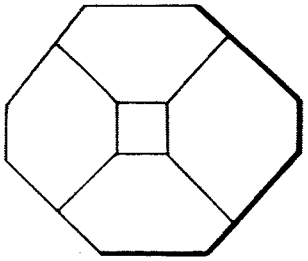
FIG. 8
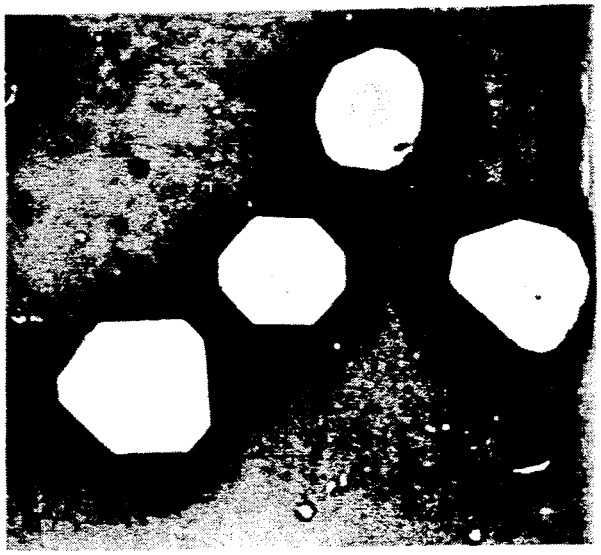

SILVER HALIDE GRAINS AND PHOTOSENSITIVE SILVER HALIDE PHOTOGRAPHIC MATERIALS

This application is a continuation, of application Ser. No. 541217, filed Jun. 20, 1990, now abandoned, which is a continuation, of application No. 254,398 filed Oct. 6, 1988, now abandoned.

This Application claims the priority of U.S. patent application Ser. No. 254,398, filed Oct. 6, 1988; which claims the priority of Japanese Application 260626/87, filed Oct. 14, 1987.

FIELD OF THE INVENTION

The present invention relates to silver halide crystal grains that constitute silver halide emulsions where the silver halide crystals are assigned to have specified faces, and furthermore photosensitive silver halide photographic materials which contain such crystal grains and exhibit an effect of their specified crystal faces on the photographic properties.

BACKGROUND OF THE INVENTION

In recent years the requirements that silver halide emulsions for photographic materials are expected to satisfy have been getting severer. Such emulsions are required to be more and more upgraded in photographic performance, the demand being intensified for higher sensitivity, better graininess, enhanced sharpness, lower fogging density, and sufficiently high optical density.

Well known as high sensitivity emulsions in an attempt to meet these requirements are silver bromoiodide emulsions containing less than 10 mol % silver iodide. And known as conventional methods for preparing these emulsions are so-called an ammonia method, a neutralization method, an acidity method, and the like, where the conditions of pH and pAg are controlled, and a single jet method and a double jet method for mixing.

On the basis of these known techniques, there have been detailed studies on technical potentialities with an object of upgrading sensitivity, graininess, sharpness and reducing fogging, some of the accomplishments of such studies having been brought into practice. Especially, the emulsions of silver bromide and silver bromoiodide have been studied to such an extent that not only crystal phase, grain size distribution, etc. of an emulsion but density distribution of silver iodide in the individual silver halide grains has come to be controlled in some of the studies.

In an attempt to upgrade a silver halide emulsion in photographic performance such as sensitivity, graininess, sharpness, fogging density and covering power, the most orthodox way is to enhance the quantum efficiency of silver halide. For this purpose a related scope of knowledge in solid-state physics is positively being introduced into the studies. According to observations on quantum efficiency based on theoretical calculations, an effective method for enhancing the quantum efficiency is to prepare an emulsion in a monodispersed system by narrowing grain size distribution. Moreover in chemical sensitization, a process to sensitize silver halide emulsions, a monodispersed emulsion is considered advantageous in an attempt to achieve an high sensitivity efficiently while fogging is held low.

What is required for commercial production of a monodispersed emulsion is to control the rates at which a silver ion and halide ion, both theoretically determined, are fed to a reaction system and to give adequate stirring under strict control of pAg and pH as specified in Japanese Patent Publication Open to Public Inspection (Toku Kai Sho) (hereinafter referred to as "Japanese Patent O.P.I. Publication") No. 54-48521/1979. The silver halide emulsion obtainable at these conditions consists of so-called regular crystals in either form of cube, octahedron or tetradecahedron with (100) and (111) planes in various ratios. It is known that by forming such regular crystal grains it is possible to efficiently sensitize silver halide emulsions.

In an attempt to impart high sensitivity to silver halide grains a success is reported by Japanese Patent O.P.I. Publication Nos. 61-35440/1986 and 60-222842/1985, both of which disclose silver bromoiodide grains with (110) planes, having the excellent photographic properties, whereas an accomplishment in reducing fog is reported by Japanese Patent Examined Publication (Toku Koh Sho) No. 55-42737/1980, which discloses a photographic emulsion containing silver chlorobromide grains in the form of rhombic dodecahedron with (110) planes.

Further augmentation of sensitivity is reported to be possible in Japanese Patent O.P.I. Publication No. 61-83531/1986, according to which silver bromide and silver bromoiodide crystals produced have a ridgeline in the middle of (110) plane. This crystal face is considered to be of a very high order, the relevant properties being described in the disclosure of Japanese Patent O.P.I. Publication No. 61-83531/1986. This crystal face is represented as (nnl), for example, (331).

There are described crystal faces other than the above in Japanese Patent O.P.I. Publication Nos. 62-124551/1987, 62-124550/1987 and 62-123447/1987.

On the other hand, some silver bromoiodide emulsions consisting of polydispersed twinned crystals are known to be advantageous for production of high sensitivity photographic films. Flat twinned crystals are included in some of such silver bromoiodide emulsions, as is described in, for example, Japanese Patent O.P.I. Publication No. 58-113927/1983.

The application of such twinned crystals is effective in enhancing sensitivity, but the crystals tend to become such irregular in shape and size that it is difficult to control the photographic properties accurately and to achieve good reproducibility.

Consideration of the effect of chemical sensitization raises as a problem a disadvantage or difficulty of commercial production of silver halide grains having (111) planes, since chemical sensitization of regular crystals is so dependent upon a crystal phase that, for example, compared with (100) planes a sensitizing reaction by an ordinary method produces a large number of sulfur sensitization nuclei on (111) planes, and a scattered formation of latent images results eventually in inefficient sensitization.

For example, both Japanese Patent O.P.I. Publication No. 50-63914/1975 and West German OLS Patent No. 2,419,798 describe an augmentation of sensitivity, where a monodispersed silver halide emulsion consisting of cubes containing silver bromide in a molar ratio of over 80% is sulfur sensitized and then, a hydroxytetrazaindene compound is added, whereas these Publications disclose that sensitivity of an emulsion containing the crystals other than cube, for example, octahedron consisting substantially of (111) planes, rather decreases or very slightly increases.

Although the regular crystals mentioned above lend themselves to accurate control for giving the grains specific character, the presence of so many equivalent faces, edges and corners in an isotropic regular crystal results in scattering equivalently the effects of chemical sensitization and exposure so that possibility of activation of the light-sensitive nuclei and/or the image-developing nuclei, which potentialize development, is reduced. The application of the regular crystals runs counter to the so-called principle of concentration. In other words, the effects of chemical sensitization and exposure are not concentrated because of scattering of the active nuclei mentioned above.

As can be seen from the above, there is a close relationship between the crystal faces of silver halide grains and the photographic properties, and further investigation of such relationship leads to possibility of successful development of silver halide emulsions upgraded in photographic properties.

SUMMARY OF THE INVENTION

One object of the present invention is to provide silver halide regular crystal grains whose properties conform to the principle of concentration (crystals which are perfectly free from twinning are called regular crystals in the present invention).

Another object of the present invention is to provide new photosensitive silver halide photographic materials comprising the emulsions containing such silver halide regular crystal grains.

The objects of the present invention can be met by silver halide regular crystal grains which have a crystal one or two habit characterized by two crystal faces and by photosensitive silver halide photographic materials having at least one layer of silver halide emulsion containing such silver halide untwinned crystal grains.

BRIEF DESCRIPTION OF THE DRAWINGS

FIGS. 1, 3, 5, and 7 show silver halide crystals in schematic models which relate to the present invention.

FIGS. 2, 4, 6, and 8 are electron microscopic photographs of silver halide crystals relating to the present invention.

FIG. 1 is a regular tetradecahedral crystal;

FIG. 2 is an electron microscopic photograph of a comparative emulsion (EM-1), which consists of regular tetradecahedral crystals;

FIG. 3 illustrates an anisotropic tetradecahedral crystal of the present invention in a schematic model (a crystal having irregularly, grown in one normal (111) direction as seen from the direction normal to the adjacent (111) plane (an arrow indicates normal direction of anisotropic growth));

FIG. 4 is an electron microscopic photograph of a crystal (EM-2) represented by the model of FIG. 3;

FIG. 5 illustrates a untwinned anisotropic tetradecahedral crystal of the present invention in a schematic model (a crystal having irregularly grown in one normal (111) direction as seen from this normal direction (this normal direction is approximately perpendicular to the paper));

FIG. 6 is an electron microscopic photograph of the crystals of FIGS. 5 and 7-*b;*

FIGS. 7-*a, b* illustrate each an anisotropic tetradecahedral crystal of the present invention in a schematic model, which has irregularly grown in two normal (111) directions;

FIG. 8 is an electron microscopic photograph of a crystal represented by the model of FIG. 7-*a.*

DETAILED DESCRIPTION OF THE INVENTION

Figure 1:
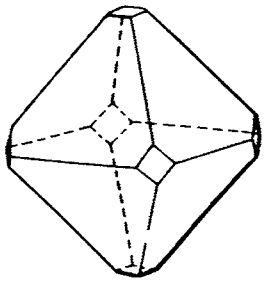

Generally, a silver halide crystal contained in a silver halide emulsion include the crystal faces with specialized Miller indices, which preponderantly develops in accordance with the densities of silver and halide ions arranged thereon, lattice energy, surface energy, or other conditions for crystal growth, so that the crystal is provided with a specialized crystal phase. Furthermore, if there are differences in conditions for growth of crystals and the conditions affect the grain size of the crystals, there may occur differences in size of the crystal faces even between faces with the same Miller indices, thus each crystal developing a crystal habit.

On the other hand, since the plane that results in an ultimate crystal face providing a crystal with crystal phases grows in a normal direction at the smallest rate (A. Johnsen, 1910), a silver halide crystal of a cubical system can be provided with a crystal form of a specified crystal phase by introducing selected conditions for growth.

For example, a silver halide of a cubical system having a crystal form of hexahedron (cube) for its crystal phase can be formed by introducing conditions for slower growth of cubical planes, that is, the deposition of silver and halide ions thereon at a lower rate than on the crystal planes with other Miller indices.

When a silver halide host grain in the form of an octahedron consisting of (111) planes is converted to that of a hexahedron (cube), additional deposition of silver halide at the conditions for depressed growth of cubical (100) planes forms at an intermediate stage a cubic octahedron, that is to say, a tetradecahedron in the form of an octahedron with the six corners cut away, and subsequently a grain consisting entirely of cubical planes as (111) planes gradually disappear. Then, the resultant cubical crystal grains grow larger as silver halide is precipitated.

Converse process makes it possible to form an octahedral crystal from a cubical crystal as a host grain.

Similarly, for example, a triaxisoctahedral grain can be formed from a cubical crystal as a host grain. By introducing conditions for slower growth of triaxisoctahedral planes in a normal direction than that of the crystal planes of other Miller indices, continued deposition of silver halide causes first a crystal plane of a triaxisoctahedron to become observable and subsequently the host grain to consist entirely of triaxisoctahedral planes.

At this stage of crystalization, silver halide precipitated further cannot help depositing only on triaxisoctahedral planes which grow slowly and therefore, do not readily accept deposition of silver halide thereon. This situation expedites formation of another group of triaxisoctahedral crystals.

When formation of the new triaxisoctahedrons has to be avoided, the rate of additional deposition of silver halide must be depressed. A known technique is applicable to this depression of the deposition rate.

Also, with regard to crystals having crystal faces of tetraxishexahedron, icosatetrahedron or hexoctahedron, the introduction of the conditions for depressed growth of the planes forming the individual crystal phases makes it possible to obtain the desired crystals.

The factors that influence the conditions for growth of silver halide grains with said various crystal phases are diversified, including the composition of silver halides, densities of the ions arranged on the crystal faces, temperature, lattice energy, surface energy, adsorbate, and solvent for silver halide. A growth modifier which retards deposition of silver halide on the crystal faces is one of the preceding factors.

However, there have been scarecely available so far the theories on the relationships between the diversified factors influencing growth of crystals and the shapes of crystals produced. Especially, almost no theoretical reports have been found regarding how to make the crystal grains with the specific crystal habits in such a free suspension system as is the case of the present invention, by promoting growth of two planes at most in a normal direction among the crystal planes with the same Miller indices and depressing growth of sizes of the crystal planes concerned, while growth of the other crystal planes is maintained at least at a normal level. Therefore, the technique to form an intended crystal shape was searched for practically by trial and error.

In the present invention, there have been studied the variations of the production conditions for the aimed crystals, such as pAg, temperature, addition rate of silver halide, in order to find out the optimum conditions. Of such variations, especially the presence of a photosensitive dye as a growth modifier at the final stage of production reaction has been found to provide a regular crystal with a specific crystal habit in the form of tetradecahedron, wherein the crystal consists of (100) and (111) planes which are rated effective for developing sensitivity, and the two (111) planes at most degenerate.

The crystal with a crystal one or two habit characterized by two faces of the present invention is a regular tetradecahedral crystal which consists of six (100) planes comprising three substantial squares and three rectangles, and eight (111) planes comprising three anisotropically grown planes, four normal planes and one anisotropically degenerated plane.

Anisotropy of crystal can be promoted by doping with a metallic complex during a growth process.

These untwinned crystals of the present invention are preferably used for photographic materials in a monodispersed emulsion which is prepared by a known method. Furthermore, the grains of a core/shell type, especially of a multiple core/shell type are preferable.

The schematic models and the electron microscopic photographs of these regular crystals with a crystal habit of the present invention are exhibited in FIGS. 3 through 8.

A photosensitive photographic material embodying the present invention can be made based on any of the silver halides applicable to ordinary silver halide emulsions, such as silver bromide, silver bromoiodide, silver chloroiodide, silver bromochloride, silver bromochloroiodide or silver chloride, but is is preferable to use especially silver bromide, silver bromoiodide or silver bromochloroiodide.

The silver halide grains for a silver halide emulsion may be formed by any of an acidity process, a neutralization process and an ammonia process. The grains can be grown continuously or grown by forming stepwise seed crystals. The seed crystals may be formed and subsequently grown by the same method or by introducing different methods for the respective steps.

A halide ion and a silver ion for a silver halide emulsion may be brought together to be mixed simultaneously or one may be added to a solution of another. Also, in coordination with a critical growth rate of the silver halide crystals, a halide ion and a silver ion can be brought gradually and simultaneously together into a mixing vessel under control of pH and pAg. This method enables to form the silver halide crystals with regular crystal shape and almost uniform grain size.

The silver halide grains can be grown in the presence of a known solvent for silver halides, such as ammonia, thioether or thiourea.

A silver halide grain can be provided with metallic elements within the grain and/or on its surface by adding on a process of its formation and/or growth at least one kind of metallic ion which is selected from the groups consisting of the salts of cadmium, zinc, lead, thallium, iridium, rhodium and iron and their complexes. A silver halide grain can be furnished with reduction sensitive nuclei within the grain and/or on its surface in a suitable reductive environment.

When growth of the silver halide grains has been completed, unnecessary soluble salts may be removed therefrom or may remain. Removal of the salts can be carried out by the method described in Research Disclosure (hereinafter abbreviated as RD) No. 17643 under Item II.

In combination with the untwinned crystals having a crystal habit peculiar to this invention, can be used for photographic material the crystals with regular forms, such as cubes, octahedrons or tetradecahedrons, or with irregular forms, such as spheres or plates. These crystals with regular and irregular forms may have (100) and (111) planes at any ratio.

A preferable size of a silver halide grain ranges 0.05–30 μm, especially 0.1–3.0 μm.

The silver halide grains used together with the inventive grains may have any grain size distribution. Either polydispersed emulsion having a wide grain size distribution or monodispersed emulsion having a narrow grain size distribution may be used. Monodispersion is defined hereby a quotient of less than 0.20 obtained by dividing a standard deviation of a grain size distribution by average grain size. A grain size is represented by length of one side of the cube with the same volume as the grain concerned. A monodispersed emulsion can be used singly or can be mixed with other monodispersed emulsion. A mixture of polydispersed emulsions and monodispersed emulsions is also useful.

Two or more kinds of silver halide emulsions prepared independently can be mixed for use.

The embodiments of the present invention are subjected to conventional chemical sensitization. For chemical sensitization of photographic materials, it is desirable to use a sulfur sensitizer or selenium sensitizer, while the chalcogen sensitizers for chemical sensitization include tellurium sensitizer besides the above two. Any known sulfur sensitizer is applicable to the present invention, for example, thiosulfate, allyl thiocarbamide, thiourea, allyl isothiocyanate, cystine, p-toluenethiosulfonate, and rhodanine. Other sulfur sensitizers applicable are mentioned in the disclosures of U.S. Pat. Nos. 1,574,944, 2,410,689, 2,278,947, 2,728,668, 3,501,313, and 3,656,955, West German OLS Patent No. 1,422,869, and Japanese Patent O.P.I. Publication Nos. 56-24937/1981 and 55-45016/1980. Such a sulfur sensitizer is used in a quantity sufficient for enhancing the sensitivity of an emulsion efficiently. This proper quantity added varies widely depending on various conditions—pH, temperature, size of the silver halide grains—but usually, the range of approx. $10^{-7}$ mol to approx. $10^{-1}$ mol of sulfur sensitizer per mole silver halide is preferable.

Applicable as selenium sensitizers are fatty isoselenocyanates such as allyl isoselenocyanate, selenoureas, selenoketones, selenoamides, selenocarboxylic acids and their esters, selenophosphates, and selenides such as diethylselenide and diethyl diselenide, of which examples are found in the disclosures of U.S. Pat. Nos. 1,574,944, 1,602,592, and 1,623,499.

The appropriate quantity of a selenium sensitizer as is the case of a sulfur sensitizer, varies widely but usually this quantity is at the range of approx. $10^{-7}$ mol to approx. $10^{-1}$ mol per mole silver halide.

A large variety of gold compounds, either monovalent or trivalent are applicable as gold sensitizers for the present invention. The typical examples are chloraurate, potassium chloroaurate, auricrichloride, potassium auricthiocyanate, potassium iodoaurate, tetracyanoauric acid, ammonium aurothiocyanate, and pyridyltrichlorogold.

The appropriate quantity of a gold sensitizer varies depending on various conditions but usually this quantity is at the range of approx. $10^{-7}$ mol to approx. $10^{-1}$ mol per mole silver halide.

A gold sensitizer can be added simultaneously with a sulfur sensitizer or a selenium sensitizer during or after sensitization process with a sulfur or selenium sensitizer.

A emulsion of the present invention is sensitized with a sulfur, selenium or gold sensitizer preferably at pAg of to 10.0 and pH of 5.0 to 9.0.

Also applicable additionally to chemical sensitization of the inventive emulsions are metallic salts of other noble metals such as platinum, palladium, iridium, rhodium and their complexes.

Complexes of Rh, Pd, Ir, Pt, etc. are useful as effective compounds for promoting migration of gold ion from gold-gelatinate and adsorption to the silver halide grains.

Examples of these compounds are $(NH_4)_2[PtCl_4]$, $(NH_4)_2[PdCl_4]$, $K_3[IrBr_6]$, and $(NH_4)_3[RhCl_6]12H_2O$, and especially tetrachloropalladium (II) acid ammonium $(NH_4)_2PdCl_4$ is preferable. The quantity added is preferably as 10–100 times large as that of gold sensitizer in terms of stoichiometric ratio (mole ratio). The addition can be made at an initial stage or after completion of chemical sensitization, but preferably during chemical sensitization. It is especially preferable to add simultaneously with gold sensitizer, or before or after its addition.

Further, reduction sensitization is applicable to the emulsions of this invention. The reducing agents are not restricted to any specific items, and some examples of the known reducing agents applicable are stannous chloride, thiourea dioxide, hydrazine derivatives and polyamines. The silver halide grains are subjected to reduction sensitization while they grow, preferably after chalcogen sensitization, gold sensitization and noble metal sensitization have been finished.

A nitrogenized heterocyclic compound, preferably a compound having an azaindene ring, may be used additionally in chemical sensitization process. The quantity of a nitrogenized hetrocyclic compound added varies widely depending on the size of the emulsion grains, composition, conditions of chemical sensitization, etc., but the preferably quantity added is such that it forms layers of monomolecular to ten moleculars on the surface of the silver halide grains. A possible method of adjusting this addition quantity is to control a condition of adsorption equilibrium by adjusting pH and/or temperature in a sensitization process. Two or more kinds of nitrogenized heterocyclic compounds can also be added to an emulsion in such quantity that total quantity of two or more kinds of the preceding compounds added does not exceed the prescribed limit.

These compounds are dissolved in such suitable solvent as neutral to the emulsions (e.g. water or an alkaline aqueous solution), and is added as solution. This solution is preferably added beforehand or simultaneously with addition of sulfur sensitizer or a selenium sensitizer for chemical sensitization. A gold sensitizer can be added on the way of or after completion of sensitization with a sulfur sensitizer or a selenium sensitizer.

By introducing a sensitizing dye the silver halide grains can furthermore be sensitized optically to a desired wavelength range.

An antifogging agent, stabilizer, etc. can be added to silver halide emulsion. Gelatin is useful as a binder for emulsion.

The emulsion layers and other hydrophilic colloidal layers can be hardened. They can also contain a plasticizer or a dispersion of a synthetic polymer (latex) which is insoluble or difficult to dissolve in water.

In the emulsion layers of a color photographic material, couplers are included; furthermore, there are contained colored couples having a color correcting effect, competitive couplers, and the compounds which release photographically useful fragments by coupling with a oxidezed product of a developing agent, such as development accelerator, bleaching accelerator, developer, solvent for silver halide, toner, hardener, fogging agent, antifogging agent, chemical sensitizers, spectral sensitizers, and desensitizer.

A photosensitive photographic material is provided with auxiliary layers, such as filter layer, antihalation layer, and antirradiation layer; these layers and/or the emulsion layers can hold the dyes which are discharged from the photographic material or bleached during a developing process.

The photographic material may furthermore contain formalin scavenger, fluorescent whitening agent, matting agent, lubricant, image stabilizer, surfactant, anticolor-fogging agent, development accelerator, development retardand and bleach accelerator.

A support material may be made of paper laminated with polyethylene, etc., polyethylene terephthalate film, baryta paper, cellulose triacetate, etc.

Development of dye image formed on photographic material of the present invention can be subjected to a generally known color photographic processing after exposure.

EXAMPLE

The present invention will hereunder be described in detail on the understanding that the description should in no way restrict the scope and spirit of the present invention to the embodiments described herein.

Prior to describing the embodiments, and emulsion prepared for the purpose of comparison will be described next.

Comparison 1

An emulsion EM-1 for comparison was prepared using seven kinds of solution which are specified next.

| | |
|---|---|
| Solution A | |
| Osseine gelatin | 10.9 g |
| Sodium salt of polyisopropylene-polyethyleneoxy-disuccinicester | 10% |
| Ethanol (aqueous solution) | 3.5 ml |
| 4-hydroxy-6-methyl-1,3,3a,7-tetrazaindene (0.5% aqueous solution) | 45.2 ml |
| 28% aqueous ammonia | 164 ml |
| 56% acetic acid (aqueous solution) | 258 ml |
| Seed emulsion (0.8 μm octahedral silver bromoiodide, AgI content 2.6 mol %, silver halides content 0.158 mol) | 67.2 ml |
| Distilled water | 2333 ml |
| Solution B | |
| Osseine gelatin | 3.5 g |
| KBr | 121.4 g |
| KI | 30.49 g |
| 4-hydroxy-6-methyl-1,3,3a,7-tetrazaindene (0.5% aqueous solution) | 75.6 ml |
| Distilled water was added to make the total quantity | 350 ml |
| Solution C | |
| Osseine gelatin | 4.7 g |
| KBr | 180.9 g |
| KI | 13.6 g |
| 4-hydroxy-6-methyl-1,3,3a,7-tetrazaindene (0.5% aqueous solution) | 100.8 ml |
| Distilled water was added to make the total quantity | 466.7 ml |
| Solution D | |
| Osseine gelatin | 4.7 g |
| KBr | 190 g |
| KI | 0.81 g |
| 4-hydroxy-6-methyl-1,3,3a,7-tetrazaindene (0.5% aqueous solution) | 100.8 ml |
| Distilled water was added to make the total quantity | 466.7 ml |
| Solution E | |
| $AgNO_3$ | 407 g |
| 28% aqueous ammonia | 362.8 ml |
| Distilled water was added to make the total quantity | 648.6 ml |
| Solution F | |
| 50% KBr (aqueous solution) an amount for adjusting pAg | |
| Solution G | |
| 50% acetic acid (aqueous solution) an amount for adjusting pH | |

At 50° C., by using a mixing stirrer referred to in the disclosures of Japanese Patent O.P.I Publication Nos. 57-92523/1982 and 57-92524/1982, solutions E and B were added to solution A over a period of 98 minutes by a simultaneous mixing method; just after finishing addition of solution B, solution C was added over a period of 50 minutes and thereafter solution of D started and completed in 42 minutes. pAg, pH and the addition rates of solutions E, B, C and D during simultaneous mixing were controlled as shown in Table 1. pAg and pH were controlled by adjusting the flow rates of solution F and G with roller tube pumps with a variable flow mechanism. Two minutes after completing addition of solution E, pH was adjusted to 6.0 by adding solution G.

The mixture was then subjected to washing for desalting by an conventional method and, after being dispersed in aqueous solution containing 44.3 g osseine gelatin, the total quantity was adjusted to 1.050 ml with distilled water.

By electron-microscopic ovseration this emulsion was found a high grade monodispersed emulsion consisting of octahedron, of which average grain size is 2.0 μm and a variation coefficient of grain size distribution is 12%.

This was silver bromoiodide emulsion of core/shell type, where content of silver iodide distributed in order of 15 mol %, 5 mol % and 0.3 mol % in a grain from core to shell.

TABLE 1

| Time | Addition rate of solvent (ml/min) | | | | | |
|---|---|---|---|---|---|---|
| Minutes | E | B | C | D | pAg | pH |
| 0 | 1.27 | 1.27 | — | — | 8.70 | 9 |
| 25.78 | 1.81 | 1.81 | — | — | 8.70 | 9 |
| 39.32 | 2.09 | 2.09 | — | — | 8.70 | 9 |
| 54.05 | 2.39 | 2.39 | — | — | 8.70 | 9 |
| 67.15 | 2.65 | 2.65 | — | — | 8.70 | 9 |
| 78.62 | 3.14 | 3.14 | — | — | 8.70 | 9 |
| 88.35 | 3.67 | 3.67 | 3.67 | — | 8.91 | 8.89 |
| 100.35 | 5.25 | — | 5.25 | — | 9.26 | 8.71 |
| 110.3 | 8.92 | — | 8.92 | — | 9.69 | 8.49 |
| 120.04 | 7.11 | — | 7.11 | — | 10.20 | 8.20 |
| 131.02 | 6.21 | — | 6.21 | 6.21 | 10.20 | 8.20 |
| 140.95 | 5.80 | — | — | 5.80 | 10.20 | 7.82 |
| 150.32 | 5.50 | — | — | 5.50 | 10.20 | 7.68 |
| 163.91 | 5.24 | — | — | 5.24 | 10.20 | 7.50 |

EXAMPLE 1

An emulsion EM-2 of anistropic untwinned silver halide crystals of the present invention was prepared in the same manner as in Comparison 1, except that two kinds of sensitizing dye solutions, mentioned hereunder, were added 141 minutes after the first addition started.

| | |
|---|---|
| Sensitizing dye (I) | 0.2% in aqueous methonol, prepared in a quantity of 128.8 ml |
| Sensitizing dye (II) | 0.2% in aqueous methanol, prepared in a quantity of a 151 ml |

Sensitizing dye (I)

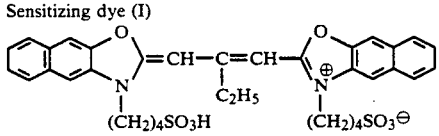

Sensitizing dye (II)

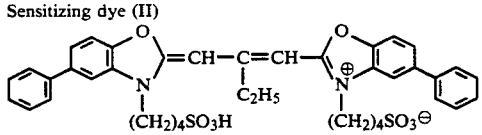

By electron-microscopic observation the emulsion EM-2 of the present invention was found to comprise the anisotropic untwinned tetradecahedral crystals consisting of six (100) planes and eight (111) planes and to be characterized by one or two (111) planes irregularly grown in a normal direction.

The schematic models and the electron microscopic photographs of the crystals of EM-1 and EM-2 are exhibited in FIG. 1 to FIG. 8.

Figure 2:
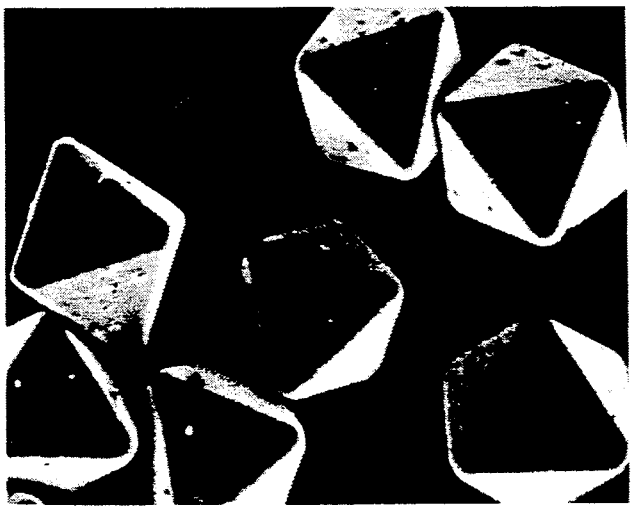
Figure 3:
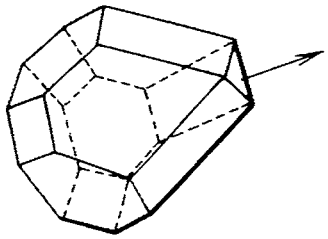
Figure 4:
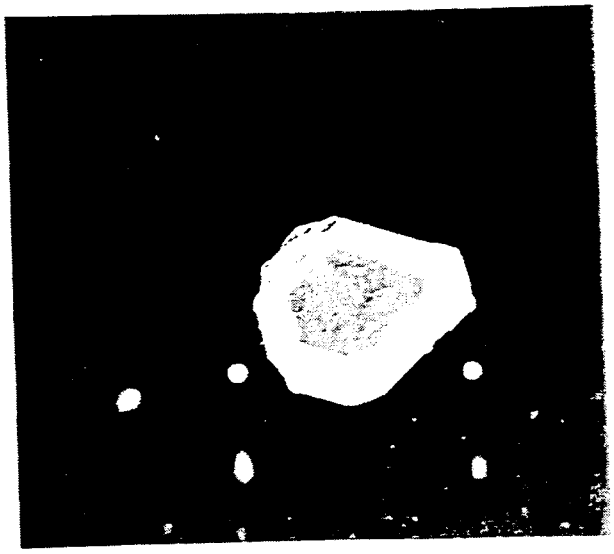
Figure 5:
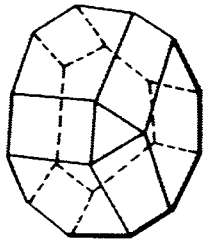
Figure 6:
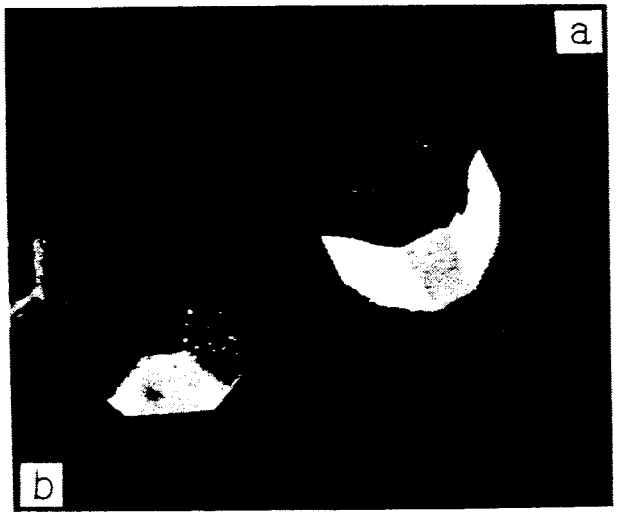

FIGS. 1 and 2 represent EM-1 and the rest represent EM-2. It is noted from the foregoings that the emulsions of the present invention comprise the untwinned crystals characterized by one or two sites where the specific crystal habits are developed.

EXAMPLE 2

A description will be given hereunder with respect to application of an emulsion of the present invention to an exemplified photosensitive materials having two layers, i.e. an emulsion layer containing a coupler and a protective layer.

A magenta-developing coupler was used in this example, which was pyrazolotriazole represented by the formula (A).

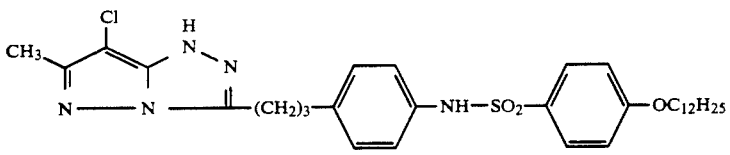

(A)

Di-tertiary nonylphenol (DNP) was introduced as a high boiling point solvent for dissolving a coupler. The coupler was dispersed in the manner of oil protect by a conventional method.

The silver bromoiodide emulsions (EM-1 and EM-2) in the foregoing description were chemically sensitized to an optimal extent with an unstable sulfur compound and a gold salt in accordance with an conventional method. The comparative emulsion EM-1 was sensitized to green by adding in chemical sensitization the sensitizing dyes (I) and (II) of the same quantity as EM-2 in EXAMPLE 1.

The first layer . . .

A high sensitized green-sensitive emulsion layer containing 1.8 g of the preceding silver bromoiodide emulsion to which both chemical and color sensitization were given, 1.9 g of gelatin, and a dispersion of 0.06 g DNP (ditertiary nonylphenol) in which 0.20 g of magenta coupler and 0.049 g of colored magenta coupler were dissolved.

The second layer . . .

A yellow filter layer containing 0.15 g of yellow colloidal silver, 1.5 g of gelatin, and a dispersion of 0.11 g DBP (dibutyl terephthalate) in which 0.2 g of antistaining agent was dissolved.

Besides the above-mentioned components, a gelatin hardener and a surfactant were added to each of the preceding two layers.

Each specimen was subjected to sensitometry by wedge exposure to green light in accordance with a conventional method.

After exposure, each specimen was subjected to the following steps of processing:

| | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The processing solutions used at the above steps were as follows:

| Color Developer | |
|---|---|
| 4-amino-3-methyl-N-(β-hydroxyethyl)-aniline sulfate | 4.57 g |
| Anhydrous sodium sulfate | 4.25 g |
| Hydroxylamine ½ sulfite | 2.0 g |
| Anhydrous potassium carbonate | 37.5 g |
| Sodium bromide | 1.3 g |
| Nitrilotriacetic acid-3 sodium salt (1 aqueous salt) | 2.5 g |

-continued

| Color Developer | |
|---|---|
| Potassium hydroxide | 1.0 g |

The total quantity was made 1 l by adding water.

| Bleacher | |
|---|---|
| Ethylenediamine tetraacetate-iron ammonium salt | 100.0 g |
| Ethylenediamine tetraacetate-2 ammonium salt | 10.0 g |
| Ammonium bromide | 150.0 g |
| Glacial acetic acid | 10.0 ml |

The total quantity was made 1 l by adding water and pH was adjusted to 6.0 with aqueous ammonia.

| Fixer | |
|---|---|
| Ammonium thiosulfate | 175.0 g |
| Anhydrous ammonium sulfite | 8.6 g |
| Sodium metasulfite | 2.3 g |

The total quantity was made 1 l by adding water and pH was adjusted to 6.0 with acetic acid.

| Stabilizer | |
|---|---|
| Formalin (37% solution) | 1.5 ml |
| Konidax (product of Konica Corp.) | 7.5 ml |

The total quantity was made 1 l by adding water.

The developed specimens were subjected to sensitometry using green light.

Fogging

The lowest optical density represented by the so-called specific curve obtained by sensitometry (the larger the optical density, the greater the fogging and less preferable).

Sensitivity

An inverse number of an exposure (true value) giving an optical density of 'fogging+0.1' on the specific curve; in the table showing the results, sensitivity is represented by a value relative to that of a comparative emulsion at normal exposure (1/50 sec. exposure), which is set at 100; the larger the value, the faster the sensitivity, and more preferable.

The sensitometric results are shown in Table 2.

EXAMPLE 3

Preparation of multilayer color photographic photosensitive materials:

A color photographic photosensitive material which had 9 photographic layers thereon, including 3 photosensitive layers sensitive to blue, green and red respectively, were prepared introducing a silver bromoiodide emulsion provided with both chemical and color sensitizations by the same technique as the single color-sensitive example in the foregoing description. The different emulsion EM-1 or EM-2 provided with chemical and color sensitization was applied to the 5th layer, a green-sensitive high sensitivity layer. The common emulsions were used for the other photosensitive layers of the two specimens.

The specimens were prepared by providing the undermentioned layers in sequence on a transparent support consisting of cellulose triacetate film provided thereon with a subbing layer and an antihalation layer (containing 0.40 g black colloidal silver and 3.0 g gelatin). In the following examples quantity of any component or additive is expressed in terms of per square meter and in case of the silver halide emulsions and the colloidal silver quantity was converted to that of elemental silver.

Layer 1:

A low-sensitivity red-sensitive emulsion layer consisting of 1.4 g of low sensitivity silver bromoiodide emulsion (silver iodide content 7 mol %) sensitized to red, 1.2 g of gelatin, 0.8 g of 1-hydroxy-4-(β-methoxyethylaminocarbonylmethoxy)-N-[δ-(2,4-di-t-amylphenoxy)butyl]-2naphthoamide(hereinafter abbreviated as C-1), 0.075 g of disodium 1-hydroxy-4-[4-(1-hydroxy-δ-acetamido-3,6-disulfo-2-naphthylazo)phenoxy]-N-[δ-(2,4-di-t-amylphenoxy)butyl-2-naphthoamide (hereinafter referred to as colored cyan coupler (CC-1)), 0.015 g of 1-hydroxy-2[δ-(2,4-di-t-amylphenoxy)butyl]naphthoamide, and a dispersion of 0.65 g tricresylphosphate (TCP) dissolving 0.07 g of 4-octadecylsuccinimido-2-(1-phenyl-5-tetrazolylthio)-1-indanone (hereinafter referred to as DIR compound (D-1)).

Layer 2:

A high sensitivity red-sensitive emulsion layer consisting of 1.3 g of high sensitivity silver bromoiodide emulsion sensitized to red, 1.2 g of gelatin, 0.21 g of cyan coupler (C-1), and a dispersion of 0.23 g TCP dissolving 0.02 g of colored cyan coupler (CC-1).

Layer 3:

An intermediate layer consisting of 0.8 g of gelatin and a dispersion of 0.04 g dibutyl phthalate (hereinafter abbreviated as DBP) dissolving 0.07 g of 2,5-di-t-octylhydroquinone (hereinaftear referred to as antistaining agent (HQ-1)).

Layer 4:

A low sensitivity green-sensitive emulsion layer consisting of 0.80 g of low sensitivity silver bromoiodide emulsion (silver iodide content 6 mol %) sensitized to green, 2.2 g of gelatin, and a dispersion of 0.95 g TCP dissolving 0.8 g of 1-(2,4,6-trichlorophenyl)3-[3-(2,4-di-t-amylphenoxyacetamido)benzamido]-5-pyrazolone,0.15 g of 1-(2,4,6-trichlorophenyl)-4-(1-naphthylazo)-3-(2-chloro-5-octa decenylsuccinimidoanilino]-5-pyrazolone (hereinafter referred to as colored magenta coupler (CM-1)), and 0.016 g of DIR compound (D-1).

Layer 5:

A high sensitivity green-sensitive emulsion layer consisting of 1.8 g of said silver bromoiodide emulsions (EM-1 and EM-2) provided with chemical sensitization and sensitized to green, 1.9 g of gelatin, 0.20 g of said pyrazolotriazole coupler represented by the formula (A), and a dispersion of 0.06 g DNP dissolving 0.049 g of colored magenta coupler (CM-1).

Layer 6:

A yellow filter layer consisting of 0.15 g of yellow colloidal silver, a dispersion of 0.11 g DBP dissolving 0.2 g of antistaining agent (HQ-1), and 1.5 g of gelatin.

Layer 7:

A low sensitivity blue-sensitive emulsion layer consisting of 0.2 g of low sensitivity silver bromoiodide emulsion (silver iodide content 4 mol %) of sensitized to blue, 1.9 g of gelatin, and a dispersion of 0.6 g TCP dissolving 1.5 g of α-pivaloyl-α-(1-benzyl-2-phenyl-3,5-dioxoimidazolidine-4-yl)-2'-chloro-5'-[α-dodecyloxycarbonyl) etoxycarbonyl]acetranilide (hereinafter referred to as Y-1).

Layer 8:

A high sensitivity blue-sensitive emulsion layer consisting of 1.0 g of high sensitivity silver bromoiodide emulsion sensitized to blue, 1.5 g of gelatin, and a dispersion of 0.65 g TCP dissolving 1.30 g of yellow coupler (Y-1).

Layer 9:

A protective layer consisting of 2.3 g of gelatin. Sensitivity of multilayer materials The multilayer color photographic photosensitive materials thus prepared were subjected to wedge exposure to white light in accordance with a conventional method, treated with the same procedures as in the foregoing examples, and the sensitivity to green light was evaluated by sensitometry (the definition of sensitivity is just the same as in the case of said single color-sensitive specimens).

The sensitometric results are shown in Table 3.

TABLE 2

| Sample No. | Emulsion | Sensitivity of green light | Fogging |
|---|---|---|---|
| 1 | EM-1 (Comparison) | 100 | 0.28 |
| 2 | EM-2 (Invention) | 130 | 0.24 |

TABLE 3

| Sample No. | Emulsion | Sensitivity of green light | Fogging |
|---|---|---|---|
| 3 | EM-1 (Comparison) | 100 | 0.30 |
| 4 | EM-2 (Invention) | 140 | 0.26 |

As can be seen from Table 2, Sample 2 prepared using an anisotropic untwinned crystal of the present invention exhibits less fogging and remarkably high sensitivity. Further, Table 3 reveals a multi-layer sample also exhibits the results very close to those of Table 2.

Therefore, it can be concluded from the foregoings that photosensitive silver halide photographic materials prepared using an anisotropic untwinned crystal of the present invention are very excellent in sensitivity and are improved in fogging to a large extent. The preceding results clearly indicates that the concentration principle working on photosensitive nuclei rather than on fogging nuclei contributes to formation of an anisotropic regular crystal in the present invention.

What is claimed is:

1. A silver halide emulsion containing an amount of untwinned, anisotropic tetradecahedral silver halide crystal grains effective to affect the photographic properties of said emulsion.

2. The emulsion of claim 1 wherein said crystal grains have faces with only two Miller indices.

3. The emulsion of claim 2 wherein said Miller indices are [100] and [III].

4. The emulsion of claim 1 wherein said tetradecahedral grains are grown anisotropically in their normal direction.

5. The emulsion of claim 4 wherein said tetradecahedral grains consist of six faces of Miller index [100] and light faces of Miller index [III].

6. The emulsion of claim 5 wherein said crystal grains are mixed with other silver halide grains having crystal structures which are hexahedrons, octahedrons, tetradecahedrons, spheres, tabulars, or mixtures thereof.

7. The emulsion of claim 1 wherein said crystal grains consist of silver bromide, silver bromoiodide, silver chloroiodide, silver bromochloride, silver bromochloroiodide, silver chloride, or mixtures thereof.

8. The emulsion of claim 1 wherein said crystal grains have a grain structure of a core and at least one shell.

9. The emulsion of claim 8 wherein said grain structure has at least two shells.

10. The emulsion of claim 5 wherein one or two faces of said eight faces are grown anisotropically in their normal direction.

* * * * *